United States Patent [19]

Wang

[11] Patent Number: 5,040,555

[45] Date of Patent: Aug. 20, 1991

[54] INFLATABLE UMBRELLA

[76] Inventor: Cheng-Chung Wang, 7th Fl., No. 37, An-Ho Road, Taipei, Taiwan, Taiwan

[21] Appl. No.: 97,545

[22] Filed: Sep. 15, 1987

[51] Int. Cl.[5] ..... A45B 19/02

[52] U.S. Cl. ..... 135/20.2; 52/2 K

[58] Field of Search ..... 135/20 B; 52/2

[56] References Cited

U.S. PATENT DOCUMENTS

| | | | |
|---|---|---|---|
| 2,625,946 | 1/1953 | Kaston | 135/20 B |
| 2,827,066 | 3/1958 | Nussbaumer | 135/20 B |
| 3,098,229 | 7/1963 | Raabe | 52/2 F X |
| 4,370,994 | 2/1983 | Pittman | 135/20 B |

FOREIGN PATENT DOCUMENTS

| | | | |
|---|---|---|---|
| 1384052 | 11/1964 | France | 135/20 B |
| 1581207 | 8/1969 | France | 135/20 B |
| 2408325 | 7/1979 | France | 135/20 B |
| 615087 | 1/1961 | Italy | 135/20 B |
| 352796 | 4/1961 | Switzerland | 135/20 B |
| 456065 | 7/1968 | Switzerland | 135/20 B |

*Primary Examiner*—David A. Scherbel
*Assistant Examiner*—Lan Mai
*Attorney, Agent, or Firm*—McGlew & Tuttle

[57] ABSTRACT

An inflatable umbrella includes an inflatable canopy member made of first upper and lower sheets and having a central portion, a plurality of elongated air compartments which extend radially from the central portion and which are spaced apart from each other, and a plurality of web portions spacing and interconnecting the elongated air compartments. A hollow shaft member being either rigid or inflatable is connected to the canopy member.

13 Claims, 5 Drawing Sheets

INFLATABLE UMBRELLA

BACKGROUND OF THE INVENTION

This invention relates to an inflatable umbrella or a safety inflatable umbrella toy, and particularly to one having an inflatable canopy incorporating a rigid or inflatable shaft member.

SUMMARY OF THE INVENTION

The present invention provides an inflatable umbrella which comprises an inflatable canopy member including at least one first upper sheet and at least one first lower sheet which are gas-impervious and flexible and which are heat sealed together, the canopy member having a central portion, a plurality of elongated air compartments which extend radially from the central portion and which are spaced apart from each other, and a plurality of web portions spacing and interconnecting the elongated air compartments, and a hollow shaft member having an upper end connected to the central portion of the canopy.

In one aspect of the invention, the canopy member further includes at the central portion an annular connecting sheet means which is disposed between and heat-sealed to the upper and lower first sheets, the annular connecting sheet means confining a central air compartment, the central air compartment and the elongated air compartments being interconnected.

In another aspect of the invention, wherein said hollow shaft member is an elongated inflatable cylindrical envelope formed of at least one gas impervious flexible second sheet, said cylindrical inflatable envelope having a top end heat-sealed to said lower first sheet at said central portion and a bottom end.

In still another aspect of the invention, an inflatable umbrella may further include a weighted inflatable bottom envelope formed of at least one gas impervious flexible third sheet heat sealed to the bottom end of the cylindrical envelope, the bottom envelope having a weighing member disposed therein. The weighing member may be either solid or liquid.

If a liquid weighing member is used, the bottom envelope may have a first partition member dividing said bottom envelope into an upper compartment and a first lower compartment, and the liquid may be received in the first lower compartment.

Alternatively, the bottom envelope may have a second partition member extending vertically and dividing the first lower compartment into two second lower compartments, the second lower compartments having upper portions which are intercommunicated.

In still another aspect of the invention, the shaft member is a rigid hollow member having a handle connected to the lower end of the rigid hollow member, and a top connector to connect the upper end of the rigid hollow member to the central portion of the canopy member.

In an embodiment of the invention, the top connector includes a tubular wall which has an outwardly projecting annular top flange heat-sealed to the lower first sheet at the central portion and which has an bottom open end for access by the upper end of the rigid hollow member, and an engaging member formed in the inner side of the tubular wall to engage with the rigid hollow member. The engaging member may be an internal screw thread to engage a threaded upper end of the rigid hollow member. Alteratively, the engaging member may be cooperative recess and projection.

The present exemplary preferred embodiments will be described in detail with reference to the accompanying drawings, in which:

DETAILED DESCRIPTION OF THE PREFERRED EMBODIMENTS

Figure 1:
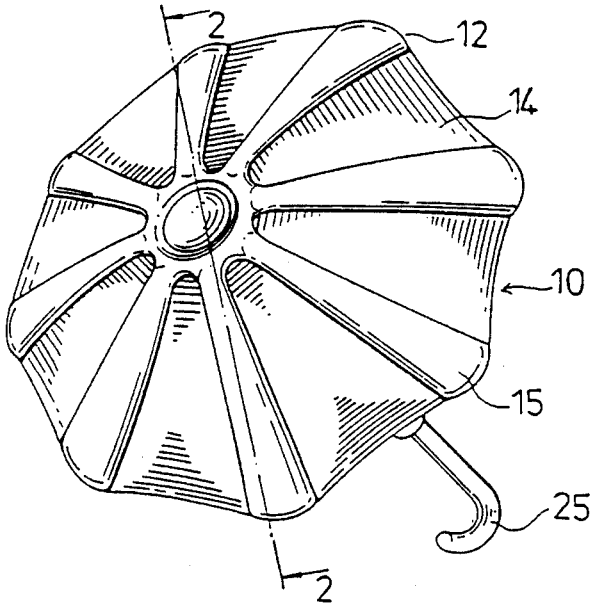
FIG. 1 is a perspective view of an inflatable umbrella of the first embodiment of the present invention.
Figure 4:
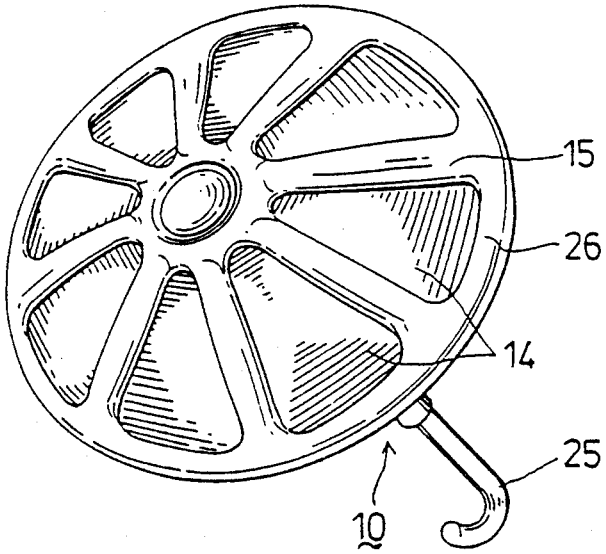
FIG. 4 is a perspective view of an inflatable umbrella having another canopy different from that of FIG. 1.
Figure 5:
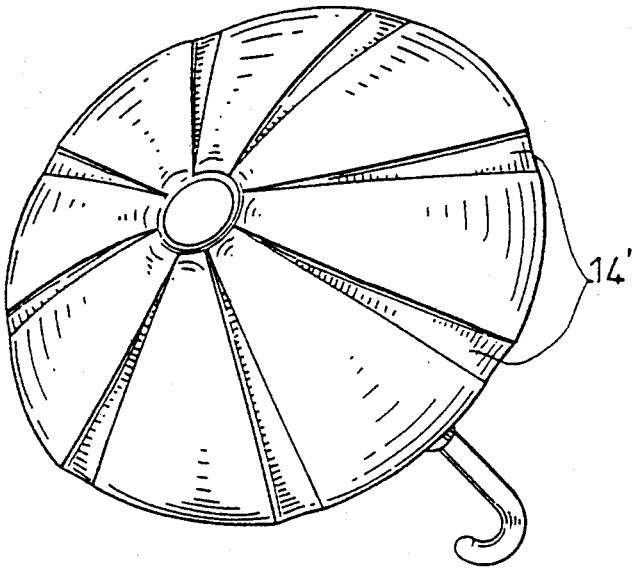
FIG. 5 is a perspective view of an inflatable umbrella having still another different canopy.

Referring to FIG. 1, a first embodiment of the invention includes an inflatable canopy member 10 made of two gas impervious one-piece sheets 11 and 12, one overlying and being heat sealed to the other. The upper sheet 12 is heat sealed to the lower sheet 10 along broad seams 14, forming radially extending air compartments 15 and a central air compartment 16. The broad seams 14 serve as the web members that space the radial air compartments 15. The central air compartment is formed by using an annular connecting sheet 13 with openings 131 therein for communicating radial compartments 15 and the central compartment 16. The upper peripheral end of the connecting sheet 13 is heat sealed to the upper sheet 12 and the lower peripheral end of the connecting sheet is heat sealed to the lower sheet 11. Instead of the one-piece canopy shape upper sheet 12, either a one-piece sheet having leaf portions radially extending from its central portion or separate sheets formed into a likewise shape can be used to fabricate the canopy 10. An inflating valve 17 is attached to the lower sheet 11. Alternatively the canopy member 10 may be in the form as shown in any one of those shown in FIGS. 4 and 5. In FIG. 4, the canopy member additionally has a circumferential air compartment 26. In FIG. 5, the heat-sealed seams 14 are narrower than the seams 14 shown in FIG. 1.

Figure 2:
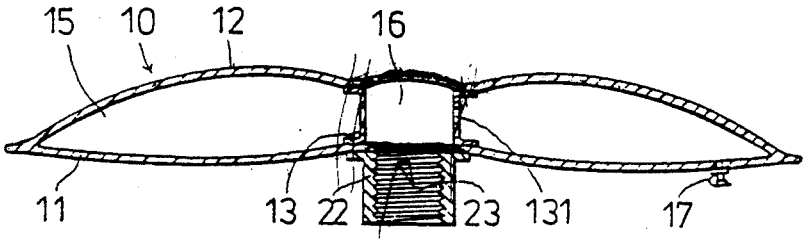
FIG. 2 is a sectional view of the canopy of FIG. 1.
Figure 3:
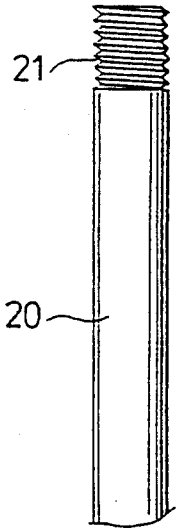
FIG. 3 is a fragmentary view showing a rigid shaft of FIG. 1 with a screw thread.

Referring to FIGS. 2 and 3, the canopy member 10 is connected to a shaft 20 by means of a connector 22. The connector 22 is a rigid hollow member having a top annular flange heat sealed to the lower sheet 11 and an internal screw thread 23 to engage with an external thread 21 of the shaft 20. At the bottom end of the shaft 20 is a handle 25.

Figure 6:
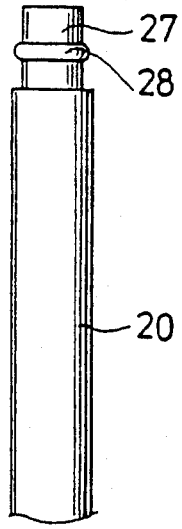
FIG. 6 is a fragmentary elevation view showing a rigid shaft with an annular engaging projection at its neck portion.
Figure 7:
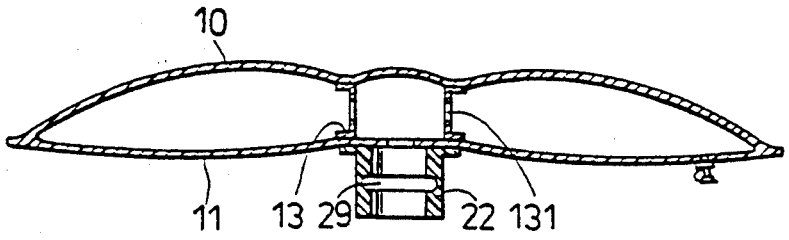
FIG. 7 is a sectional view showing a canopy to be connected to the shaft of FIG. 6.
Figure 8:
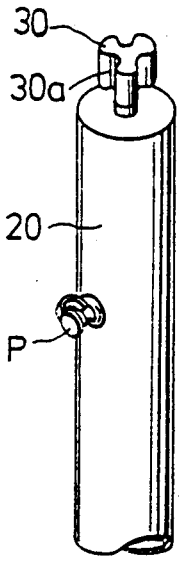
FIG. 8 is a fragmentary elevation view showing another rigid shaft with axial grooves in its neck portion.
Figure 9:
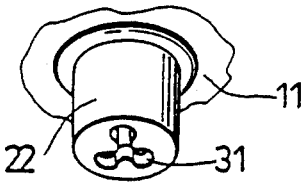
FIG. 9 is a fragmentary view showing a connector of the canopy to be in connection with the shaft of FIG. 8.

Alternatively, as shown in FIGS. 6 and 7, the shaft 20 may be provided with a topmost neck portion 27 with an annular protrusion 28 to engage with an annular recess 29 provided at the inner side of the tubular wall of the connector 22. Moreover, the neck portion 30 of the shaft 20 may be arranged to have axial grooves 30*a* as shown in FIG. 8, instead of a circular cross-section of the neck portion 27 of FIG. 6. The neck portion 30 can engage with a slot 31 of the connector 22 as shown in FIG. 9.

Figure 10:
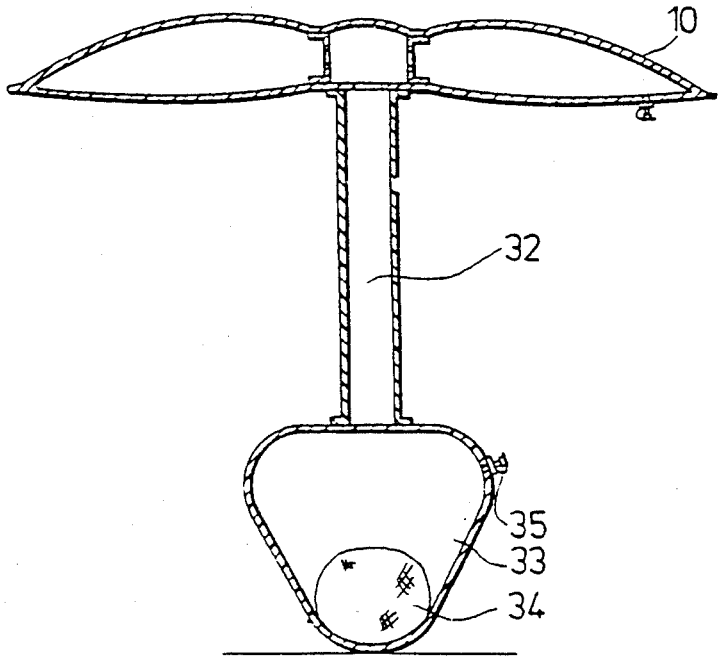
FIG. 10 is a sectional view of an umbrella having an inflatable shaft and a weighted inflatable bottom envelope with a fixed weighing member.

Referring to FIG. 10, a second embodiment of the invention includes a canopy member 10, a shaft 32 formed by an elongated inflatable cylindrical envelope which has a top end heat-sealed to the lower sheet 11 at the central portion of the canopy 10, and a weighted inflatable bottom envelope 33 heat sealed to the bottom end of the shaft 32. The bottom envelope 33 may either be communicated or non-communicated with the shaft 32 and the canopy 10. Inside the bottom envelope 33 is a weighing member 34. The weighing member may be a bag of sand or water. The sand or water bag is secured to the inner surface of the wall of the envelope 33 so that the bag is immovable in the envelope 33. The umbrella so arranged is always in an upright position.

Figure 11:
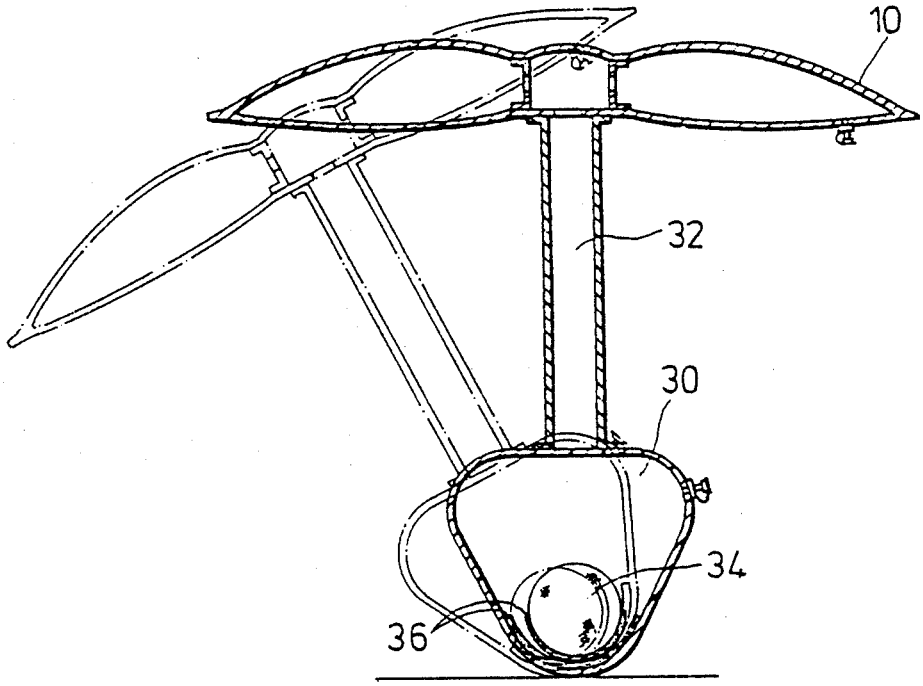
FIG. 11 is a sectional view of an umbrella having a weighted bottom envelope with a position adjustable weighing member.

Alternatively, the weighing bag 34 may be secured releaseably to the inner side of the envelope 33 by means of a hook-and-loop fastener 36, as shown in FIG. 11. As such, the weighing bag 34 can be bonded to the envelope 33 at a desired position by moving the envelope 33, the shaft 32 or the canopy 10, and the canopy 10 can be positioned at a desired inclined position so as to shelter one from the sun.

Figure 12:
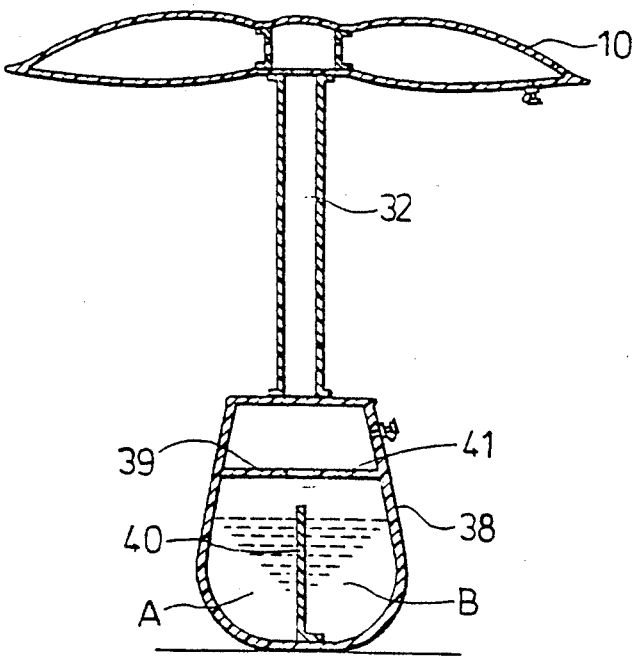
FIG. 12 is a sectional view of an umbrella having a weighted bottom envelope with a liquid weighing member.
Figure 13:
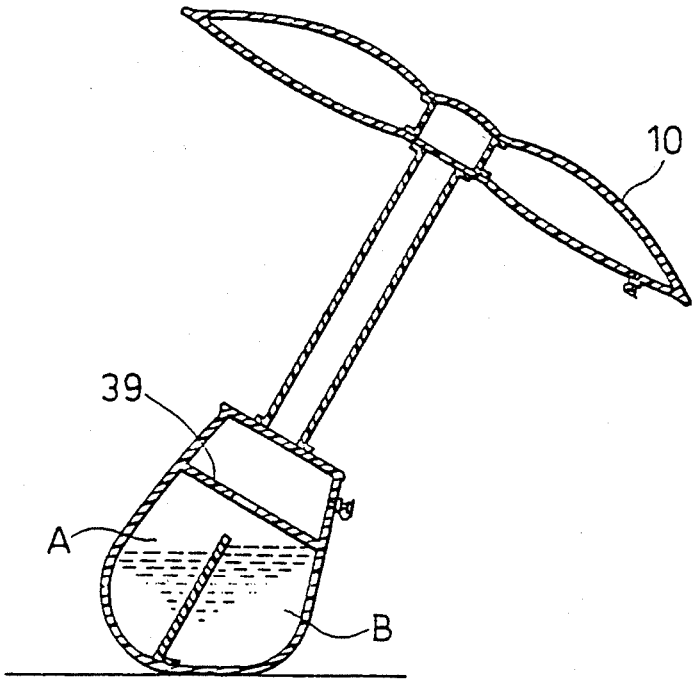
FIG. 13 is a sectional view of an umbrella of FIG. 12 which is in an inclined position.

Instead of the weighted bottom envelope 33, a weighted bottom envelope 38 can be attached to the shaft 32 as shown in FIG. 12 and 13. The bottom envelope 38 includes a first partition member 39 dividing the envelope 38 into an upper compartment for receiving air and a lower compartment for receiving water, and a second partition member 40 extending vertically and dividing the lower compartment into two compartments A and B. The compartments A and B are intercommunicated at their upper portions since the second partition member 40 has an opening 41 at its upper portion. The level of the water initially introduced into the lower compartments A and B is not higher than the lower side of the aperture 41 of the second partition member 40, but the water in one of the compartments A and B can be caused to flow into the other compartment when the envelope 38 is squeezed or slanted so that the water in the other compartment increases and the bottom envelope 38 is slanted. The bottom envelope 38 so arranged enables the canopy 10 to be slanted toward any direction the user desires.

What is claimed is:

1. An inflatable umbrella comprising: an inflatable canopy member including at least one first upper sheet and at least one first lower sheet which are gas-impervious and flexible and which are heat sealed together, said canopy member having a central portion, a plurality of elongated air compartments which extend radially from said central portion and which are spaced apart from each other and a plurality of web portions spacing and interconnecting said elongated air compartments, said canopy member central portion having a flexible, cylindrical, connecting sheet which is disposed between said upper and lower first sheets, the cylindrical connecting sheet having upper and lower, axially spaced, marginal portions heat sealed to a lower side of the upper sheet and an upper side of the lower sheet, respectively and defining a central air compartment, said central air compartment and said elongated air compartments being interconnected and a hollow shaft member heat-sealed to the lower side of the lower sheet and separated from the cylindrical connecting sheet by the lower sheet.

2. An inflatable umbrella as claimed in claim 1, wherein said hollow shaft member is an elongated inflatable cylindrical envelope formed of at least one gas impervious flexible second sheet, said cylindrical inflatable envelope having a top end heat-sealed to said lower first sheet at said central portion and a bottom end.

3. An inflatable umbrella as claimed in claim 2, further comprising a weighted inflatable bottom envelope formed of at least one gas impervious flexible third sheet heat sealed to said bottom end of said cylindrical envelope, said bottom envelope having a weighing member disposed therein.

4. An inflatable umbrella as claimed in claim 3, wherein said weighing member is selected from a solid and a liquid.

5. An inflatable umbrella as claimed in claim 4, in which said weighing member is a solid, wherein said solid is secured to said third sheet.

6. An inflatable umbrella as claimed in claim 1, wherein said hollow shaft member is a rigid member having an upper end, a lower end, a handle connected to said lower end of said rigid hollow member, and a top connector connected to said upper end of said rigid hollow member and heat-sealed to said central portion of said canopy member.

7. An inflatable umbrella as claimed in claim 6, wherein said top connector includes a tubular wall which has an outwardly projecting annular top flange heat-sealed to said lower first sheet at said central portion and which has an bottom open end for access to the interior of said tubular wall of said top connector by said upper end of said rigid hollow member, and an engaging means formed in the inner side of said tubular wall to engage with said rigid hollow member.

8. An inflatable umbrella as claimed in claim 7, in which said engaging means is an internal screw thread, wherein said upper end of said rigid hollow member includes an external screw thread to engage with said internal screw thread.

9. An inflatable umbrella as claimed in claim 7, in which said engaging means is an annular recess in said tubular wall of said top connector, wherein said upper end of said rigid hollow member includes a neck portion having an annular projection to engage with said annular recess.

10. An inflatable umbrella as claimed in claim 7, in which said engaging means includes axial grooves formed on said tubular wall of said top connector, wherein said upper end of said rigid hollow member has a neck portion having axial protrusions thereon to engage with said axial grooves.

11. An inflatable umbrella comprising:

an inflatable canopy member including at least one first upper sheet and at least one first lower sheet which are gas-impervious and flexible and which are heat sealed together, said canopy member having a central portion, a plurality of elongated air compartments which extend radially from said central portion and which are spaced apart from each other, and a plurality of web portions spacing and interconnecting said elongated air compartments, said canopy member central portion having annular connecting sheet means which is disposed between and heat-sealed to said upper and lower first sheets, said annular connecting sheet means confining a central air compartment, said central air compartment and said elongated air compartments being interconnected, said hollow shaft member being an elongated an inflatable cylindrical envelope formed of at least one gas impervious flexible second sheet, said cylindrical inflatable envelope having a top end heat-sealed to said lower first sheet at said central portion and a bottom end, a weighted inflatable bottom envelope formed of at least one gas impervious flexible third sheet heat sealed to said bottom end of said cylindrical envelope, said bottom envelope having a weighing member disposed therein, said weighing member being selected from a solid and a liquid, said solid having a hook and a loop fastener means for bonding releaseably said solid to said third sheet at a desired position, said weighing member being a liquid, wherein said bottom envelope has a first partition member dividing said bottom envelope into an upper compartment and a first lower compartment, said liquid being received in said first lower compartment.

12. An inflatable umbrella comprising: an inflatable canopy member including at least one first upper sheet and at least one first lower sheet which are gas-impervious and flexible and which are heat sealed together, said canopy member having a central portion, a plurality of elongated air compartments which extend radially from said central portion and which are spaced apart from each other, and a plurality of web portions spacing and interconnecting said elongated air compartments, said canopy member central portion having annular connecting sheet means which is disposed between and heat-sealed to said upper and lower first sheets, said annular connecting sheet means confining a central air compartment, said central air compartment and said elongated air compartments being interconnected, said hollow shaft member being an elongated an inflatable cylindrical envelope formed of at least one gas impervious flexible second sheet, said cylindrical inflatable envelope having a top end heat-sealed to said lower first sheet at said central portion and a bottom end, a weighted inflatable bottom envelope formed of at least one gas impervious flexible third sheet heat sealed to said bottom end of said cylindrical envelope, said bottom envelope having a weighing member disposed therein, said weighing member being selected from a solid and a liquid, said weighing member being a liquid, wherein said bottom envelope has a first partition member dividing said bottom envelope into an upper compartment and a first lower compartment, said liquid being received in said first lower compartment.

13. An inflatable umbrella as claimed in claim 12, in which said bottom envelope further has a second partition member extending vertically and dividing said first lower compartment into two second lower compartments, said second lower compartments having upper portions which are intercommunicated.

* * * * *